US005480237A

United States Patent [19]

Tanahashi

[11] Patent Number: 5,480,237

[45] Date of Patent: Jan. 2, 1996

[54] COLOR PRINTER HAVING A RIBBON CONTROLLER

[75] Inventor: Makoto Tanahashi, Kanagawa, Japan

[73] Assignee: Sony Corporation, Tokyo, Japan

[21] Appl. No.: 375,225

[22] Filed: Jan. 19, 1995

Related U.S. Application Data

[63] Continuation of Ser. No. 44,500, Apr. 9, 1993, abandoned.

[30] Foreign Application Priority Data

Apr. 13, 1992 [JP] Japan ..... 4-091329

[51] Int. Cl.[6] ..... B41J 35/18

[52] U.S. Cl. ..... 400/120.02; 400/210.2; 347/177; 347/178

[58] Field of Search ..... 400/216.2, 216.3, 400/240.3, 120.02, 223, 224.2, 216.1; 347/172, 174, 177, 178

[56] References Cited

U.S. PATENT DOCUMENTS

| | | | |
|---|---|---|---|
| 4,594,597 | 6/1986 | Liu et al. | 400/240.3 |
| 4,625,218 | 11/1986 | Watanabe | 400/240.3 |
| 4,642,655 | 2/1987 | Sparer et al. | 400/240.3 |
| 4,652,154 | 3/1987 | Horiya et al. | 400/240.3 |
| 4,692,774 | 9/1987 | Nagashima et al. . | |
| 4,893,951 | 1/1990 | Iwatani et al. | 400/240.3 |
| 4,949,097 | 8/1990 | Imaseki . | |
| 5,104,247 | 4/1992 | Ohshima | 400/240.3 |
| 5,123,760 | 6/1992 | Tsurn et al. | 400/216.2 |

FOREIGN PATENT DOCUMENTS 0304823 3/1989 European Pat. Off. .

*Primary Examiner*—Ren Yan
*Assistant Examiner*—John S. Hilten
*Attorney, Agent, or Firm*—Hill, Steadman & Simpson

[57] ABSTRACT

A color printing apparatus includes a printing head which prints different color segments of an ink ribbon on a sheet, and an image data memory storing a plurality of color image data corresponding to a color image. The color segment opposed to the printing head is identified. The color image data is read out and serves for judging whether or not the identified color segment is to be subjected to printing. With the judgment that the identified color segment is to be subjected to printing, the image data memory transmits a signal actuating the printing head. With the judgment that the identified color segment is not to be subjected to printing, the ink ribbon is driven to feed the next color segment so as to oppose to the printing head.

4 Claims, 3 Drawing Sheets

58
20
32
20
FEED
20
P. HEAD
30
56
54
18
60
Vout(MONITOR)
48
52
PRINT DATA CONV. UNIT
62
46
ENCODER
50
COLOR CONV./ COLOR CORR. UNIT
MICRO-COMPUTER
ROM
RAM
44
D/A CONVERTER
IMAGE DATA MEMORY
42
40
64
38
A/D CONVERTER
36
DECODER
34
Vin PRINTING OPERATION START
STEP 1
CASSETTE SET
NO
YES
RIBBON FEED
STEP 2
RIBBON FEED STOP
STEP 3
STEP 4
YELLOW ?
NO
YES
STEP 9
MAGENTA ?
NO
YES
STEP 5
YELLOW PRINT ?
NO
YES
STEP 12
CYAN ?
NO
YES
STEP 10
MAGENTA PRINT ?
NO
YES
STEP 13
CYAN PRINT ?
NO
YES
STEP 6
YELLOW PRINT DATA
STEP 11
MAGENTA PRINT DATA
CYAN PRINT DATA
STEP 14
PRINT
STEP 7
STEP 8
FINISH ?
NO
YES
END OF OPERATION

COLOR PRINTER HAVING A RIBBON CONTROLLER

This is a continuation, of application Ser. No. 08/044,500, filed Apr. 9, 1993, now abandoned.

BACKGROUND OF THE INVENTION

The present invention relates to a color printing apparatus capable of starting printing of a color image at an optional color segment of an ink ribbon used therein.

Color printers are well known in the art. Some of the color printers selectively perform a printing operation in a multicolor mode and a monocolor mode by using an ink ribbon. The ink ribbon includes a substrate film and a color layer formed on the substrate film. The color layer has a plurality of color blocks each of which includes a plurality of color segments arranged in a predetermined order, generally yellow, magenta and cyan colors.

Such color printers operable in the multicolor and monocolor modes are designed to print, in the multicolor mode, the color segments of each color block one by one on a sheet in one cycle of the printing operation. In a case where the printing operation is interrupted or stopped in the cycle upon occurrence of an emergent trouble or problem, the printlink operation restarts generally at a given color segment, for instance a yellow color segment of the next color block after feeding the ink ribbon. Thus, the next one or two color segments such as magenta and cyan color segments are not subjected to printing on the sheet.

Alternatively, in such a condition, a restart of the subsequent printing operation must wait until all the color segments of the color block are subjected to printing.

On the other hand, in the monocolor mode, only one or two given color segments of the color block are used for the printing operation.

In a case where the printing operation in the monocolor mode is changed to that in the multicolor mode, the printing operation is started from the yellow color segment of the next color block after feeding the ink ribbon. Accordingly, it is also unavoidable that the next one or two color segments are prevented from being printed on the sheet.

SUMMARY OF THE INVENTION

Accordingly, an object of the present invention is to provide a color printing apparatus capable of starting printing at an optional color segment of an ink ribbon used therein.

According to one aspect of the present invention, there is provided a color printing apparatus for printing a color image on a recording medium, in which an ink ribbon cassette including a spool and an ink ribbon wound about the spool is mounted, the ink ribbon including color blocks in which a plurality of different color segments are arranged in a predetermined order, the apparatus comprising:

a printing head printing the color segment on the recording medium;

an image data memory digitally storing a plurality of color image data corresponding to the color image;

image data memory control means for controlling the image data memory to transmit a signal for actuating the printing head;

ink ribbon control means for driving the ink ribbon to feed each of the color segments so as to be opposite and aligned with the printing head;

means for detecting and identifying the color segment aligned with the printing head; and means for reading out the color image data stored in the image data memory and judging whether or not the color segment detected and identified by the detecting and identifying means is to be subjected to printing in comparison with the color image data read out;

wherein, when the judging means judges that the color segment detected and identified is to be subjected to printing, the image data memory control means allows the image data memory to transmit the signal while, when the judging means judges that the color segment detected and identified is not to be subjected to printing, the ink ribbon control means operates to drive the ink ribbon such that the next color segment is detected and identified by the detecting and identifying means.

DESCRIPTION OF THE PREFERRED EMBODIMENT

Figure 1:
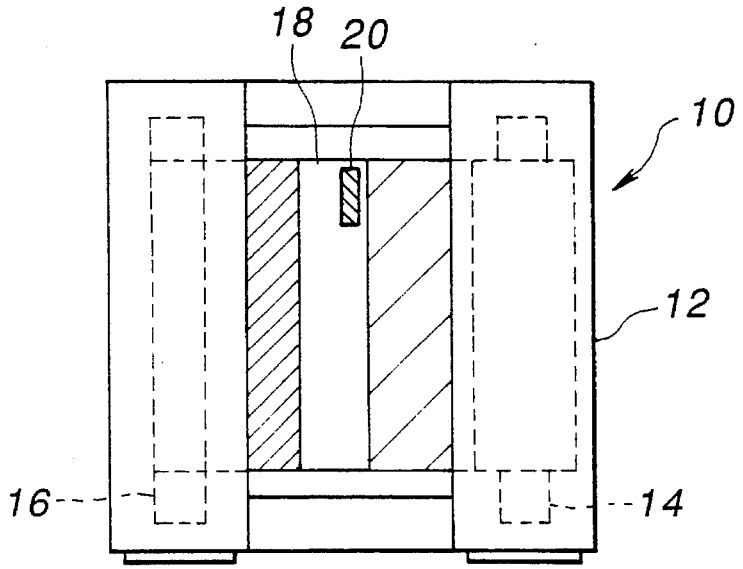
FIG. 1 is a schematic plan view of an ink ribbon cassette used in a color printing apparatus according to the present invention, showing two spools about which an ink ribbon is wound.
Figure 2:
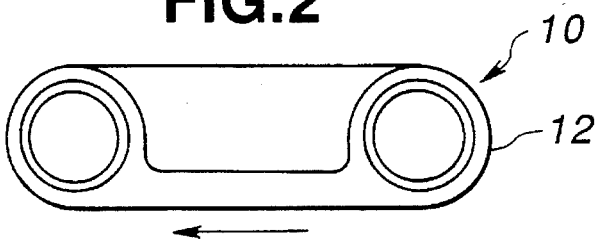
FIG. 2 is a schematic side view of the ink ribbon cassette of FIG. 2.

Referring now to FIG. 1, there is shown an ink ribbon cassette 10 including a cassette housing 12 and supply and take-up spools 14 and 16 rotatably disposed within the housing 12. An ink ribbon 18 is derived from the supply spool 14 and fed to the take-up spool 16 in a direction as indicated by an arrow in FIG. 2. The color layer of the ink ribbon 18 is exposed through a rectangular opening formed on a central portion of the housing 12 which connects two cylindrical portions carrying the supply and take-up spools 14 and 16.

Figure 3:
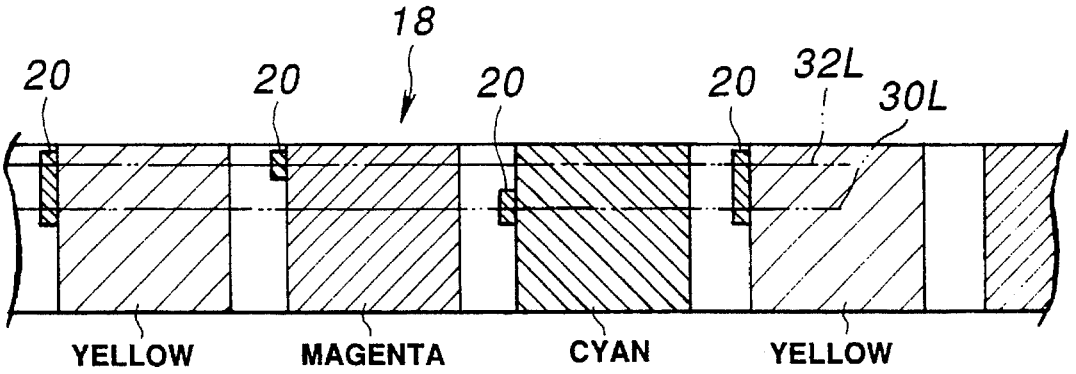
FIG. 3 is a schematic view of an ink ribbon used in the color printing apparatus, showing color segments of a color block which are arranged in a predetermined order.

As well known in the art, the ink ribbon 18 includes a substrate and a heat-sublimatable color layer formed on the substrate. The color layer includes a plurality of color blocks each of which has color segments arranged in a spaced relation and in a predetermined order, for example yellow, magenta and cyan as seen in FIG. 3. One color block is used for printing a color image on a recording medium.

As shown in FIG. 3, color identification marks 20 are disposed adjacent the respective color segments. The color identification marks 20 are in the form of a bit pattern and detected by sensors 30 and 32 which are mounted in a housing (not shown) of a color printing apparatus of the present invention, as seen in FIG. 4.

Figure 4:
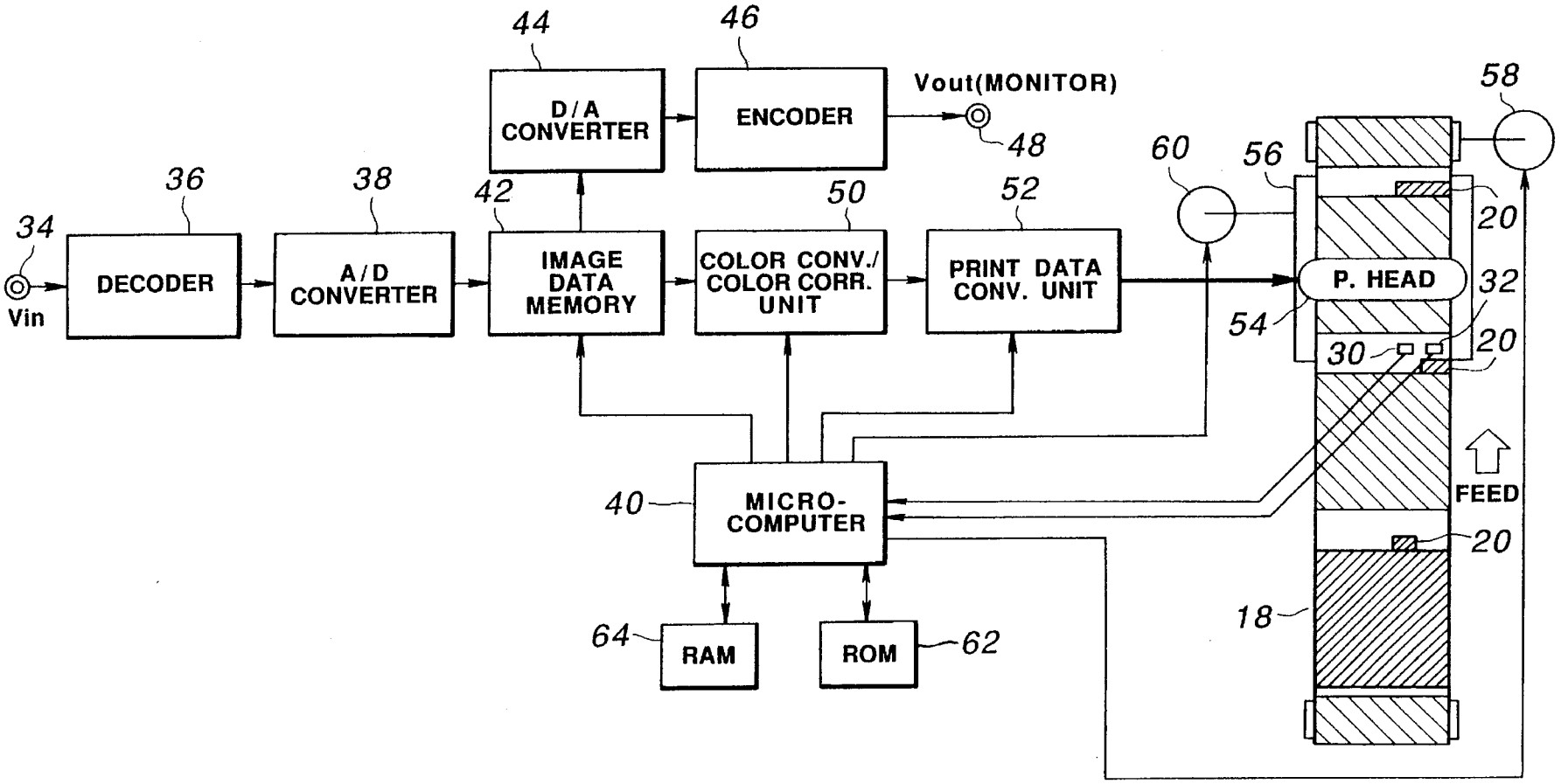
FIG. 4 is a block diagram off the color printing apparatus.

As shown in FIG. 4, the sensors 30 and 32 are laterally disposed with respect to a feeding direction of the ink ribbon 18 and in parallel to each other. As the ink ribbon 18 is fed, the color identification marks 20 move along phantom lines 30L and 32L of FIG. 3, on which the sensors 30 and 32 are positioned to detect the color identification marks 20. Upon detecting the color identification marks 20, the sensors 30 and 32 transmit detection signals to a microcomputer 40 which is electrically connected thereto. For instance, the detection signals are indicated in digital patterns (1, 1), (1, 0) and (0, 1) which correspond to yellow, magenta and cyan colors, respectively. The microcomputer 40 determines each of the color segments depending upon the detection signals from the sensors 30 and 32.

On the other hand, NTSC (National Television System Committee) color video signals corresponding to a color image are entered at an input terminal 34 (Vin). And then, the color video signals are transmitted to a color decoder 36 and converted there to RGB (red, green and blue) color signals. The RGB color signals are transmitted to an analog-digital (A/D) converter 38 and converted to digital signals corresponding thereto. The digital signals are in turn transmitted to an image data memory 42 and stored there as color image data. The image data memory 42 is electrically connected to the microcomputer 40.

Then, the microcomputer 40 transmits a read-out signal to the image data memory 42 to read out the color image data (the digitalized RGB color signals) and then compare same with the identified color segment.

Depending upon the judgment of the microcomputer 40, the color image data is transmitted from the image data memory 42 to a color conversion/color correction unit 50. The respective color image data are converted to YMC (yellow, magenta and cyan) color signals in the unit 50. The YMC color signals are transmitted to a print data conversion unit 52 and converted to print data signals therein. The print data signals are transferred to a thermal printing head 54 which is opposed to the color segment of the ink ribbon 18. The ink ribbon 18 is transported by a motor 58 to pass over a sheet 56 which is fed by a motor 60. The motors 58 and 60 are controlled by the microcomputer 40, respectively. In response to receipt of the print data signals, the thermal printing head 54 is urged against the sheet 56 through the ink ribbon 18 so that the color segment of the color image is printed on the sheet 56. In a multicolor mode, the color segments of yellow, magenta and cyan colors are in turn printed on the sheet 56.

On the other hand, the digital signals are transmitted from the image data memory 42 to a digital-analog converter (D/A converter) 44 and converted to the RGB color signals therein. The RGB color signals are transferred via an encoder 46 to be converted to the NTSC color video signals. Then, the NTSC color video signals are transmitted via an output terminal (Vout) 48 to a display monitor (not shown).

Further, the microcomputer 40 is electrically connected to a ROM 62 for storing a processing sequence, a invariant data and the like, and a RAM 64 for storing variable data in processing steps.

Figure 5:
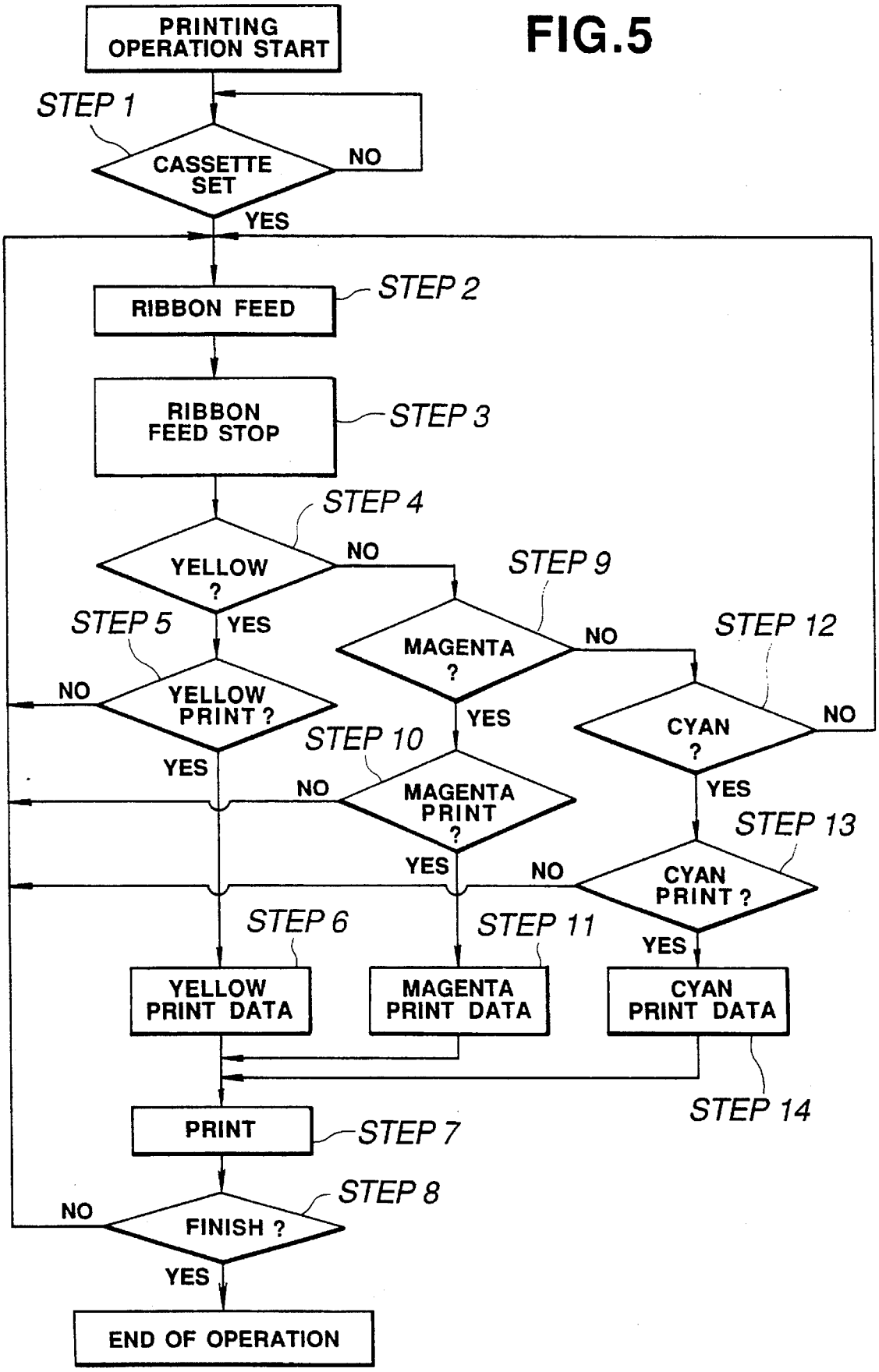
FIG. 5 is a flow chart of a printing operation of the color printing apparatus of FIG. 4.

The processing program will now be described with reference to the flow chart shown in FIG. 5.

The processing program includes Step 1 to Step 14. Subsequent to start of the printing operation, Step 1 is made to ascertain as to whether or not the ink ribbon cassette 10 is mounted at a given position in the color printing apparatus. In the case of NO, namely when the ink ribbon cassette 10 is not mounted, the program returns to an initial stage of the printing operation. In the case of YES, namely when the ink ribbon cassette 10 is mounted, the program proceeds to Step 2, Step 3 and then Step 4. In Step 2 the ink ribbon 18 is fed, and in Step 3 the feed of the ink ribbon 18 is stopped when an initial color segment is opposite or opposed to the thermal printing head 54.

In Step 4, the color identification mark 20 adjacent the color segment is detected by the sensors 30 and 32 and then a color of the color segment is identified as, for instance yellow. If the color of the color segment is not identified as yellow, Step 10 is executed as described below. If the color of the color segment is identified as yellow, the program proceeds to Step 5.

In Step 5, the color image data (the digital signal) stored in the image data memory 42 is read out and compared with results of the identification of the color segment. Then, judgment is made as to whether or not the color segment identified as having yellow in Step 4, is to be subjected to printing. If NO in Step 5, namely when the judgment is that the color segment identified as having yellow is not to be subjected to printing, the program returns to Step 2 and then proceeds to Step 3, Step 4 and Step 5. If YES in Step 5, namely when the judgment is that the color segment identified as having yellow is to be subjected to printing, Step 6 and Step 7 are in turn executed.

In Step 6, the read-out color image data is transmitted via the color conversion/color correction unit 50 to the print data conversion unit 52, to be converted to the print data signal which is in turn transmitted to the thermal printing head 54. In Step 7, the yellow color segment is printed on the sheet 56 by the thermal printing head 54 in response to the print data signal. Subsequent to Step 7, the program proceeds to Step 8. In Step 8, judgment :is made as to whether or not the printing operation is to be finished. If YES, the printing operation on the sheet 56 is ended. If NO, namely when a second color segment is to be subjected to printing, the program returns to Step 2 and repeats subsequent steps are executed for the second color segment in same manner as described above.

That is, in Step 9, the color identification mark 20 is detected and then a color of the second color segment is identified as, for instance magenta. If the color of the second color segment is not identified as magenta, the program transfers to Step 12 as described below. If the second color segment is identified as having magenta, the program proceeds to Step 10. In Step 10, the color image data stored in the image data memory 42 is read out and then compared with results of the identification of the second color segment. Then, judgment is made as to whether or not the second color segment identified as having magenta in Step 9, is to be subjected to printing. If YES, namely when the judgment is that the second color segment identified as having magenta is to be subjected to printing, Step 11, Step 7 and Step 8 are in turn executed. In Step 11, the read-out color image data is transmitted via the color conversion/color correction unit 50 to the print data conversion unit 52, to be converted to the print data signal which is transmitted to the thermal printing head 54. In Step 7, the magenta color segment is printed on the sheet 56 by the thermal printing head 54 in response to the print data signal. In Step 8, judgment is made as to whether or not the printing operation is to be finished. If YES, the printing operation is ended. If NO, namely when a third color segment is to be subjected to printing, the program returns again to Step 2.

In Step 12, the color identification mark 20 is detected and then a color of the third color segment is identified as, for instance cyan. If the third color segment is identified as having cyan, the program proceeds to Step 13. In Step 13, the color image data stored in the image data memory 42 is read out and then compared with results of the identification of the third color segment. Then, judgment is made as to whether or not the third color segment identified as having cyan is to be subjected to printing. If YES, namely when the judgment is that the third color segment identified as having cyan is to be subjected to printing, Step 14 is executed. In Step 14, the read-out color image data is transmitted via the color conversion/color correction unit 50 to the print data conversion unit 52, to be converted to the print data signal which is transmitted to the thermal printing head 54. Then, Step 7 is carried out in same manner as described above so that the cyan color segment is printed on the sheet 56. Subsequent to Step 7, the program proceeds to Step 8 to execute judgment as to whether or not the printing operation is to be finished. If YES in Step 8, the printing operation is ended. If NO in Step 8, the program returns to Step 2.

In Step 12, if the third color segment is not identified as having cyan, the program returns to Step 2. IF NO in Step 13 subsequent to Step 12, namely when the judgment is that the third color segment identified as having cyan is not to be subjected to printing, the program also returns to Step 2. As appreciated from the above description, Step 12 may be omitted in a case where the color segments of the ink ribbon consists of three color segments such as yellow, magenta and cyan colors. That is, if No in Step 9, the program proceeds directly to Step 12.

Accordingly, the color printing apparatus of the present invention can start the printing operation from an optional one of the color segments of the ink ribbon.

What is claimed is:

1. A color printing apparatus for printing a color image on a recording medium, said apparatus comprising:

first means for supporting an ink ribbon cassette, said cassette including a spool and an ink ribbon wound about the spool, said ink ribbon including color blocks in which a plurality of different color segments are arranged in a predetermined order;

a printing head for printing the color segment on the recording medium;

an image data memory digitally storing a plurality of color image data corresponding to the color image;

image data memory control means for controlling said image data memory to transmit a signal for actuating said printing head;

ink ribbon control means for driving said ink ribbon to feed each of the color segments so as to be opposite said printing head;

second means for detecting and identifying the color segment presently opposite said printing head; and third means for reading out the color image data stored in said image data memory and for judging whether or not the color segment presently detected and identified by said second means is to be subjected to printing in comparison with the color image data read out, said third means actuating the image data memory control means to transmit signals to the printing head when the third means determines that the presently detected color segment is to be printed and said third means actuating the ink ribbon control means to advance the ribbon to the next color segment when the third means determines that the presently detected color segment is not to be printed so that printing starts with the color segment detected by the second means if this color segment is to be printed.

2. A color printing apparatus as claimed in claim 1, wherein said second means includes sensors and color information marks recorded on said ink ribbon to indicate the color segments being detected by the sensors.

3. A color printing apparatus as claimed in claim 1, wherein said color segments include at least yellow, magenta, and cyan colors.

4. A method of printing a color image on a recording medium, said method comprising the steps of:

providing an apparatus comprising first means for supporting an ink ribbon cassette, said cassette including a spool and an ink ribbon wound about the spool, said ink ribbon including color blocks in which a plurality of different color segments are arranged in a predetermined order; a printing head for printing the color segment on the recording medium; an image data memory digitally storing a plurality of color image data corresponding to the color image; image data memory control means for controlling said image data memory to transmit a signal for actuating said printing head; ink ribbon control means for driving said ink ribbon to feed each of the color segments so as to be opposite said printing head; and second means for detecting and identifying the color segment presently opposite said printing head;

detecting and identifying the color segment presently opposite the printing head with the second means;

reading out the color image data stored in the image data memory to determine if the color of the color segment detected and identified by the second means is to be subjected to printing; and actuating the image data control means to operate the printing head to print the color of the color segment opposite the head if that color is to be printed, and if that color is not to be printed, actuating the ink ribbon control means to advance the ribbon to the next color segment so that printing will always start with a color segment detected by the second means if this color segment is to be printed.

* * * * *